US007093653B2

(12) United States Patent
Metcalfe et al.

(10) Patent No.: US 7,093,653 B2
(45) Date of Patent: Aug. 22, 2006

(54) DOWNHOLE FILTER

(75) Inventors: Paul David Metcalfe, Aberdeen (GB); Wayne Rudd, Newcastle Upon Tyne (GB)

(73) Assignee: Weatherford/Lamb, Houston, TX (US)

( * ) Notice: Subject to any disclaimer, the term of this patent is extended or adjusted under 35 U.S.C. 154(b) by 222 days.

(21) Appl. No.: 10/693,185

(22) Filed: Oct. 24, 2003

(65) Prior Publication Data

US 2004/0131812 A1 Jul. 8, 2004

(30) Foreign Application Priority Data

Oct. 25, 2002 (GB) ..... 0224807

(51) Int. Cl.
*E21B 43/08* (2006.01)
*B32B 1/08* (2006.01)

(52) U.S. Cl. ..... 166/230; 166/233; 428/36.9

(58) Field of Classification Search ..... 166/227, 166/233, 230
See application file for complete search history.

(56) References Cited

U.S. PATENT DOCUMENTS

| | | | | |
|---|---|---|---|---|
| 988,054 | A | 3/1911 | Wiet | |
| 1,233,888 | A | 7/1917 | Leonard | |
| 1,301,285 | A | 4/1919 | Leonard | |
| 1,880,218 | A | 10/1932 | Simmons | |
| 1,981,525 | A | 11/1934 | Price | |
| 2,017,451 | A | 10/1935 | Wickersham | |
| 2,214,226 | A | 9/1940 | English | |
| 2,383,214 | A | 8/1945 | Prout et al. | |
| 2,424,878 | A | 7/1947 | Crook | |
| 2,499,630 | A | 3/1950 | Clark | |
| 2,519,116 | A | 8/1950 | Crake | |
| 2,627,891 | A | 2/1953 | Clark | |
| 2,633,374 | A | 3/1953 | Boice | |
| 2,933,137 | A * | 4/1960 | D Audiffret et al. | 166/312 |
| 3,028,915 | A | 4/1962 | Jennings | |
| 3,039,530 | A | 6/1962 | Condra | |
| 3,167,122 | A | 1/1965 | Lang | |
| 3,179,168 | A | 4/1965 | Vincent | |
| 3,186,485 | A | 6/1965 | Owen | |
| 3,191,677 | A | 6/1965 | Kinley | |
| 3,191,680 | A | 6/1965 | Vincent | |
| 3,203,451 | A | 8/1965 | Vincent | |
| 3,203,483 | A | 8/1965 | Vincent | |
| 3,245,471 | A | 4/1966 | Howard | |
| 3,297,092 | A | 1/1967 | Jennings | |
| 3,326,293 | A | 6/1967 | Skipper | |
| 3,353,599 | A | 11/1967 | Swift | |
| 3,354,955 | A | 11/1967 | Berry | |

(Continued)

FOREIGN PATENT DOCUMENTS

DE 3213464 A1 10/1983

(Continued)

OTHER PUBLICATIONS

EP Search Report, Application No. EP 03 25 6773, dated Aug. 3, 2004.

(Continued)

*Primary Examiner*—Frank S. Tsay
(74) *Attorney, Agent, or Firm*—Patterson & Sheridan LLP

(57) ABSTRACT

A downhole filter comprises a tubular member having a wall defining a plurality of openings. The openings have an outer width less than an inner width. The parts of the opening defining the smaller width are defined by radially outer parts of the openings, such that particulates or sand prevented from passing through the openings will tend to be retained to the outside of the tubular member.

30 Claims, 3 Drawing Sheets

U.S. PATENT DOCUMENTS

| | | | | |
|---|---|---|---|---|
| 3,477,506 | A | | 11/1969 | Malone |
| 3,489,220 | A | | 1/1970 | Kinley |
| 3,583,200 | A | | 6/1971 | Cvijanovic et al. |
| 3,669,190 | A | | 6/1972 | Sizer et al. |
| 3,689,113 | A | | 9/1972 | Blaschke |
| 3,691,624 | A | | 9/1972 | Kinley |
| 3,712,373 | A | | 1/1973 | Bearden et al. |
| 3,712,376 | A | | 1/1973 | Owen et al. |
| 3,746,091 | A | | 7/1973 | Owen et al. |
| 3,776,307 | A | | 12/1973 | Young |
| 3,780,562 | A | | 12/1973 | Kinley |
| 3,785,193 | A | | 1/1974 | Kinley et al. |
| 3,820,370 | A | | 6/1974 | Duffy |
| 3,948,321 | A | | 4/1976 | Owen et al. |
| 3,977,076 | A | | 8/1976 | Vieira et al. |
| 4,133,379 | A | * | 1/1979 | Nuzman et al. ..... 166/234 |
| 4,319,393 | A | | 3/1982 | Pogonowski |
| 4,343,358 | A | | 8/1982 | Gryskiewicz |
| 4,349,050 | A | | 9/1982 | Bergstrom et al. |
| 4,359,889 | A | | 11/1982 | Kelly |
| 4,362,324 | A | | 12/1982 | Kelly |
| 4,382,379 | A | | 5/1983 | Kelly |
| 4,387,502 | A | | 6/1983 | Dom |
| 4,406,326 | A | | 9/1983 | Wagner |
| 4,407,150 | A | | 10/1983 | Kelly |
| 4,414,739 | A | | 11/1983 | Kelly |
| 4,445,201 | A | | 4/1984 | Pricer |
| 4,450,612 | A | | 5/1984 | Kelly |
| 4,470,280 | A | | 9/1984 | Kelly |
| 4,483,399 | A | | 11/1984 | Colgate |
| 4,487,630 | A | | 12/1984 | Crook et al. |
| 4,502,308 | A | | 3/1985 | Kelly |
| 4,505,142 | A | | 3/1985 | Kelly |
| 4,505,612 | A | | 3/1985 | Shelley, Jr. |
| 4,567,631 | A | | 2/1986 | Kelly |
| 4,581,617 | A | | 4/1986 | Yoshimoto et al. |
| 4,626,129 | A | | 12/1986 | Kothmann et al. |
| 4,807,704 | A | | 2/1989 | Hsu et al. |
| 4,866,966 | A | | 9/1989 | Hagan |
| 4,883,121 | A | | 11/1989 | Zwart |
| 4,901,417 | A | * | 2/1990 | Chupka et al. ..... 29/896.62 |
| 4,976,322 | A | | 12/1990 | Abdrakhmanov et al. |
| 4,997,320 | A | | 3/1991 | Hwang |
| 5,014,779 | A | | 5/1991 | Meling et al. |
| 5,031,699 | A | | 7/1991 | Artynov et al. |
| 5,046,892 | A | | 9/1991 | Kothmann |
| 5,052,483 | A | | 10/1991 | Hudson |
| 5,052,849 | A | | 10/1991 | Zwart |
| 5,156,209 | A | | 10/1992 | McHardy |
| 5,267,613 | A | | 12/1993 | Zwart et al. |
| 5,271,472 | A | | 12/1993 | Leturno |
| 5,301,760 | A | | 4/1994 | Graham |
| 5,307,879 | A | | 5/1994 | Kent |
| 5,322,127 | A | | 6/1994 | McNair et al. |
| 5,348,095 | A | | 9/1994 | Worrall et al. |
| 5,366,012 | A | | 11/1994 | Lohbeck |
| 5,409,059 | A | | 4/1995 | McHardy |
| 5,472,057 | A | | 12/1995 | Winfree |
| 5,520,255 | A | | 5/1996 | Barr et al. |
| 5,553,679 | A | | 9/1996 | Thorp |
| 5,560,426 | A | | 10/1996 | Trahan et al. |
| 5,636,661 | A | | 6/1997 | Moyes |
| 5,667,011 | A | | 9/1997 | Gill et al. |
| 5,706,905 | A | | 1/1998 | Barr |
| 5,785,120 | A | | 7/1998 | Smalley et al. |
| 5,887,668 | A | | 3/1999 | Haugen et al. |
| 5,901,789 | A | | 5/1999 | Donnelly et al. |
| 5,924,745 | A | | 7/1999 | Campbell |
| 5,938,925 | A | | 8/1999 | Hamid et al. |
| 5,960,895 | A | | 10/1999 | Chevallier et al. |
| 5,979,571 | A | | 11/1999 | Scott et al. |
| 5,984,568 | A | | 11/1999 | Lohbeck |
| 6,012,522 | A | | 1/2000 | Donnelly et al. |
| 6,012,523 | A | | 1/2000 | Campbell et al. |
| 6,029,748 | A | | 2/2000 | Forsyth et al. |
| 6,050,341 | A | | 4/2000 | Metcalf |
| 6,070,671 | A | | 6/2000 | Cumming et al. |
| 6,085,838 | A | | 7/2000 | Vercaemer et al. |
| 6,112,818 | A | | 9/2000 | Campbell |
| 6,273,634 | B1 | | 8/2001 | Lohbeck |
| 6,315,040 | B1 | * | 11/2001 | Donnelly ..... 166/207 |
| 6,325,148 | B1 | | 12/2001 | Trahan et al. |
| 6,354,373 | B1 | | 3/2002 | Vercaemer et al. |
| 6,425,444 | B1 | | 7/2002 | Metcalfe et al. |
| 6,446,323 | B1 | | 9/2002 | Metcalfe et al. |
| 6,454,013 | B1 | | 9/2002 | Metcalfe |
| 6,457,532 | B1 | | 10/2002 | Simpson |
| 6,457,533 | B1 | | 10/2002 | Metcalfe |
| 6,527,049 | B1 | | 3/2003 | Metcalfe et al. |
| 6,543,552 | B1 | | 4/2003 | Metcalfe et al. |
| 6,571,672 | B1 | | 6/2003 | Rudd |
| 6,702,029 | B1 | | 3/2004 | Metcalfe et al. |
| 6,708,769 | B1 | | 3/2004 | Haugen et al. |
| 2002/0092648 | A1 | | 7/2002 | Johnson et al. |

FOREIGN PATENT DOCUMENTS

| | | |
|---|---|---|
| DE | 4133802 C1 | 10/1992 |
| EP | 0 586 992 | 3/1994 |
| EP | 0 952 305 A1 | 4/1998 |
| EP | 1 152 120 | 11/2001 |
| FR | 2200944 | 4/1974 |
| GB | 640310 | 7/1950 |
| GB | 730338 | 3/1954 |
| GB | 792886 | 4/1956 |
| GB | 997721 | 7/1965 |
| GB | 1277461 | 6/1972 |
| GB | 1448304 | 9/1976 |
| GB | 1457843 | 12/1976 |
| GB | 1582392 | 1/1981 |
| GB | 2216926 A | 10/1989 |
| GB | 2313860 B | 6/1996 |
| GB | 2322655 A | 2/1998 |
| GB | 2329918 A | 4/1999 |
| WO | WO 92/01139 | 1/1992 |
| WO | WO 93/24728 | 12/1993 |
| WO | WO 93/25800 | 12/1993 |
| WO | WO 94/25655 | 11/1994 |
| WO | WO 96/01250 | 1/1996 |
| WO | WO 96/03261 | 2/1996 |
| WO | WO 97/17524 | 5/1997 |
| WO | WO 97/21901 | 6/1997 |
| WO | WO 98/00626 | 1/1998 |
| WO | WO 99/02818 | 1/1999 |
| WO | WO 99/18328 | 4/1999 |
| WO | WO 99/23354 | 5/1999 |

OTHER PUBLICATIONS

GB Search Report, Application No. GB 0224807.8, dated Jul. 25, 2003.

Metcalfe, P.—"Expandable Slotted Tubes Offer Well Design Benefits", *Petroleum Engineer International*, vol. 69, No. 10 (Oct. 1996), pp. 60-63—XP000684479.

* cited by examiner

DOWNHOLE FILTER

FIELD OF THE INVENTION

The present invention relates to downhole filters, methods of filtering production fluid downhole, and methods of producing downhole filters. Embodiments of the invention relate to downhole filters, such as sandscreens, for use in preventing sand or other particulates entrained in production fluid from passing from a producing formation into a wellbore.

BACKGROUND OF THE INVENTION

It is generally desirable that fluids extracted from downhole formations, such as oil and gas produced from hydrocarbon-bearing formations, are substantially free from particulates, or sand. The presence of sand in the production fluid can lead to blockages, premature wear and damage to valves, pumps and the like. Produced sand which has been separated from the produced fluid at surface requires storage and disposal, which can be difficult and expensive, particularly in offshore operations. Furthermore, unchecked production of sand from a formation can result in substantial damage to the formation itself.

Perhaps the most common means for restricting sand production involves the provision of a mechanical sand control device, installed downhole, that causes the sand to bridge or filters the produced liquids or gases. These devices come in many forms, including slotted liners and wire-wrapped screens. The simplest slotted liner is made of oilfield pipe that has been longitudinally slotted with a precision saw or mill. Such liner is relatively inexpensive, and is accordingly preferred for wells having long completion intervals, but does not have high-inlet-flow areas, and may therefore be unsuitable for high-rate wells. Wire-wrapped screens consist of keystone-shaped corrosion-resistant wire wrapped around a drilled or slotted mandrel, the wire being spaced from the mandrel by longitudinal ribs to allow for maximum flow through the screen.

Other sand control devices comprise a filter sheet sandwiched between a perforated base pipe and a perforated outer shroud. By providing the filter sheet in the form of a plurality of overlapping leaves, and providing a diametrically expandable base pipe and outer shroud, it is possible to provide an expandable sand control device, such as is sold under the ESS trade mark by the applicant. In this particular arrangement, overlapping leaves of non-expanding apertured metal filter sheet are sandwiched between a slotted expandable base pipe and a slotted expandable protective shroud. Each leaf is attached to the base pipe along an axially extending weld, and the free edges of the leaves then overlapped to provide an iris-like arrangement. On expansion of the filter, the leaves of filter sheet slide over one another, the circumferential extent of each leaf being selected such that a degree of overlap remains in the expanded configuration, such that there is a continuous wrapping of filter sheet.

While such expandable filter arrangements have been used successfully on many occasions, manufacture of the arrangements is relatively difficult and expensive, and the location and relative movement of the filter sheets during the expansion process introduces a risk of the filter sheets tearing.

Embodiments of the various aspects of the present invention provide alternative sand control devices.

SUMMARY OF THE INVENTION

According to the present invention there is provided a downhole filter comprising a tubular member having a wall defining a plurality of openings, at least a portion of one or more openings having an outer width less than an inner width. Thus, the parts of the openings defining the smaller width are defined by radially outer parts of the openings, such that particulates or sand prevented from passing through the openings will tend to be retained to the outside of the tubular member.

Thus, the parts of the openings defining the smaller width are defined by radially outer parts of the openings, such that particulates or sand prevented from passing through the openings will tend to be retained to the outside of the tubular member.

Preferably, said outer width defines the minimum width of the openings.

Preferably, said portions of one or more openings defining said outer width are located on or adjacent an outer circumference of the tubular member.

Conveniently, the openings have a keystone form, that is the openings are of generally trapezoidal section, or wedge-shaped section. However, the openings may take any appropriate form, including a nozzle-like form having convex side walls or other forms having rectilinear or non-rectilinear side walls.

Keystone-form openings may be created by laser-cutting, abrasive water jet cutting, or indeed by any conventional cutting or milling techniques.

The form of openings present in the walls of tubular members in accordance with these embodiments of the present invention is of course unlike the form of openings that would be achieved if a normally apertured planar sheet, in which openings have parallel walls, is rolled into a tubular form, which tends to create openings in which the inner width of the openings is less than the outer width. Furthermore, conventional slotted liner, made of oilfield pipe that has been longitudinally slotted with a precision saw or mill, will feature parallel side walls and will tend to have an outer length greater than an inner length. Thus this aspect of the invention provides the preferred form of openings for sand exclusion such as is achieved in wire-wrapped screens, but without the complexity and expense associated with wire-wrapped screens, and in a relatively robust form.

The openings may be of any desired configuration or orientation, or combination of configurations or orientations, including longitudinally extending openings or slots, circumferentially extending openings or slots, helically extending openings or slots, or serpentine openings or slots which may have a wave or step-form.

Preferably, the tubular member is self-supporting such that the member may be handled, and preferably also run into and installed in a bore, without requiring the provision of an additional support member or members. Most preferably, the tubular member incorporates end couplings, to allow the tubular member to be incorporated in a string of tubulars. The tubular member may feature threaded end portions, such as pin and box connections, or may have ends adapted to co-operate with coupling sleeves. The number and form of the openings may be determined with a view to providing the tubular member with a desired strength, and crush resistance, and as such will depend upon, for example, the wall thickness of the tubular member, the diameter of the member, the material from which the member is formed, and whether the member has been or will be heat-treated, cold worked, or its material properties otherwise altered or modified.

In other embodiments, the tubular member may be provided in combination with one or more other tubular members located internally or externally thereof, which other tubular members may serve a support or protection function, or may provide a filtering function. One embodiment of the invention includes an inner support pipe, within the tubular member, but is absent any external protective shroud.

In certain embodiments the tubular member may be diametrically expandable. Such expansion may be accommodated in a number of ways, for example the wall of the member may extend or otherwise deform, which may involve a change in the form of the openings. In one embodiment, the wall of the tubular member may incorporate extendible portions, such as described in our PCT\GB2003\001718, the disclosure of which is incorporated by reference. However, a preferred extensible tubular member features substantially circular openings which, following diametric expansion, assume a circumferentially-extending slot-form of smaller width than the original openings. Preferably, the original openings are laser-cut.

According to another aspect of the present invention there is provided a wellbore filter comprising a tubular member having a plurality of openings therethrough, the openings having a serpentine configuration.

Aspects of the present invention also relate to methods of filtering wellbore fluids, one method comprising:

placing a downhole filter within a wellbore, with the downhole filter comprising a tubular member having a wall defining a plurality of openings, at least a portion of one or more openings having an outer width less than an inner width, with the outer width sized to filter wellbore particulate matter; and passing wellbore fluids into an interior passage of the tubular member through the openings.

According to a yet further aspect of the present invention there is provided a downhole filter arrangement comprising a metal tubular member defining a plurality of laser-cut perforations.

Existing tubular members are slotted to create filters using a precision saw or mill. The use of a precision cutting tool is necessary to provide the accurately controlled slot width required to provide an effective filter with predictable sand control properties. However, the applicant has now achieved the previously unattainable accuracy required of filter slots or openings by laser-cutting. Conventionally, a slot cut by laser has a larger width at the slot ends, where cutting commenced and stopped, producing "dogbone" slots, which are of little if any utility in filter applications. A conventional laser cutting operation utilises a substantially constant laser energy input, and when cutting commences the laser is held stationary relative to the workpiece until the laser has cut through the depth of the metal, before moving along the workpiece to cut the slot, and then coming to a stop at the end of the slot. Applicant believes that, without wishing to be bound by theory, where the laser is held stationary relative to the workpiece, energy transfer to the workpiece from the laser creates a pool of molten metal surrounding the area of metal which is removed by vaporisation, and this pool of molten metal is removed from the workpiece with the vaporised metal. This has the effect that the width of cut is increased relative to areas where the laser is moving relative to the workpiece, and where less metal is removed by this mechanism. The applicant has found that it is possible to avoid this problem by controlling the laser energy during the cutting process, and more particularly by reducing the laser energy when the laser is stationary relative to the workpiece. By doing so it has been possible to cut slots of consistent width, suitable for use in filtering applications. Other techniques may be utilised to control slot width, including reducing the flow rate of purging gas, and thus reducing the rate of removal of molten metal. Alternatively, or additionally, a pulsed laser may be used, which laser produces discrete energy pulses such that, in use, a laser spot is not focussed on the workpiece for a time which is sufficient to allow thermal energy to be conducted into the metal surrounding the cutting zone.

There are a number of advantages gained by utilising laser to cut the perforations. Firstly, the perforations may be of forms other than those achievable by means of a conventional rotating cutting tool, and in particular it is possible to cut narrow slots of a serpentine form. Secondly, laser cutting tools may operate in conjunction with a gas purge, which carries away the vaporised and molten metal, and cools the surrounding material. An oxygen purge may be utilised to help the exothermic reaction at high temperatures, but for the present application an inert gas purge is preferred. However, in addition to merely cooling the metal, the gas purge jet has been found to produce a quenching effect at the edges of the cut, tending to increase the hardness of the metal surrounding the cut, particularly the outer edges of the perforations. Of course this is the area of the perforation which is likely to have to withstand the greatest erosion.

According to another aspect of the present invention there is provided a method of creating a downhole filter arrangement comprising laser-cutting a plurality of perforations in a metal filter member.

According to a still further aspect of the present invention there is provided an expandable downhole filter arrangement comprising an expandable base tube and a deformable metal filter sheet mounted around the base tube, the filter sheet defining a plurality of laser-cut perforations.

Surprisingly, it has been found that relatively thin laser-perforated metal filter sheet may be deformed, and in particular extended, with minimal risk of tearing. It has been found that the perforations, which are typically originally substantially circular, tend to deform on diametric expansion of the filter sheet to assume the form of elongate slots of width less than the diameter of the original perforations.

Laser-cut perforations tend to have a keystone or trapezoidal section, and the filter sheet is preferably arranged such that the smaller diameter end of each perforation in the filter sheet is adjacent the outer face of the sheet.

It has been found that the laser-perforated sheet is sufficiently robust to obviate the requirement to provide a protective shroud around the exterior of the sheet, thus simplifying the manufacture of the expandable filter arrangement.

The laser-perforated sheet may be initially provided in planar form, and then wrapped or otherwise formed around the base tube. The edges of the sheet may be joined by any convenient method, such as a seam weld.

BRIEF DESCRIPTION OF THE DRAWINGS

These and other aspects of the present invention will now be described, by way of example, with reference to the accompanying drawings, in which.

DETAILED DESCRIPTION OF THE DRAWINGS

Figure 1:
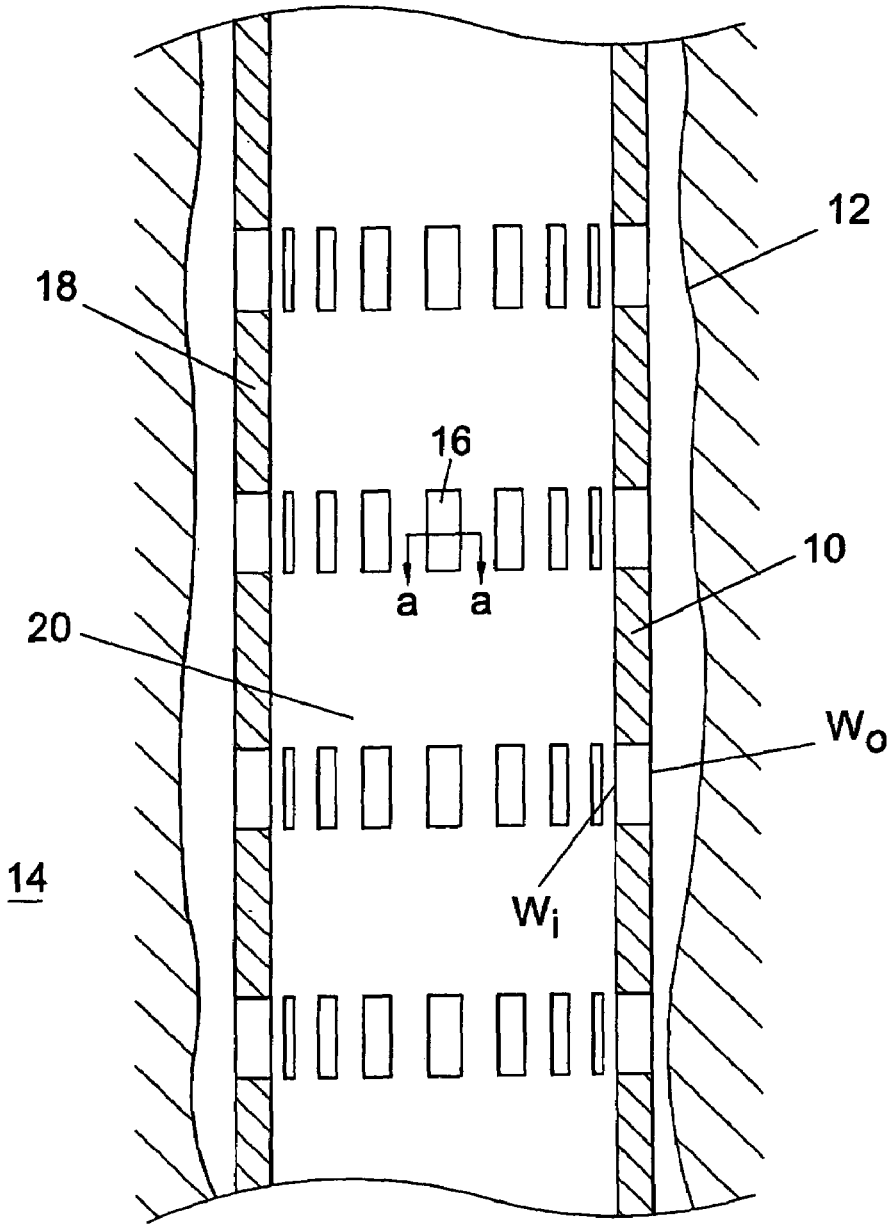
FIG. 1 is a schematic sectional view of part of a downhole filter in accordance with an embodiment of one aspect of the present invention, the filter shown located in a wellbore.

Reference is first made to FIG. 1 of the drawings, which is a schematic sectional view of a sand control device in the form of downhole filter 10, in accordance with an embodiment of an aspect of the present invention. The filter 10 is shown located in a wellbore 12 which has been drilled from surface to intersect a sand-producing hydrocarbon-bearing formation 14.

Figure 1A:
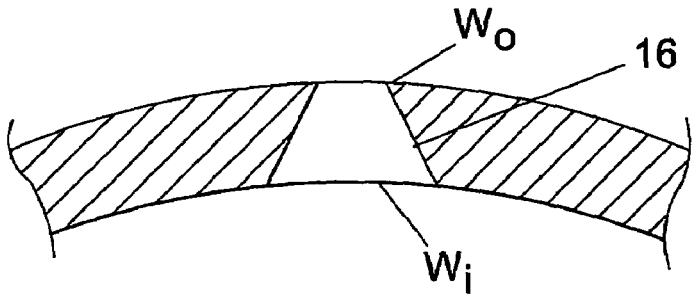
FIG. 1*a* is an enlarged schematic sectional view on line a—a of FIG. 1.

The filter 10 comprises a metal tubular in which a large number of longitudinally-extending slots 16 have been cut. The slots 16 have a keystone or trapezoidal form, that is the width of the slots increases from the exterior of the tubular wall wo to the interior wi. This feature is shown in FIG. 1*a*, which is an enlarged sectional view of a slot 16 through line a—a of FIG. 1. As shown, the inner slot width wi is greater than the outer slot width wo. The outer, minimum width wo is selected to be smaller than the diameter of the particulates it is desired to prevent from passing from the formation 14, through the tubular wall 18, and into the tubular bore 20 (those of skill in the art will of course realise that the dimensions of the slots 16, in this and other figures, have been exaggerated).

Figure 2:
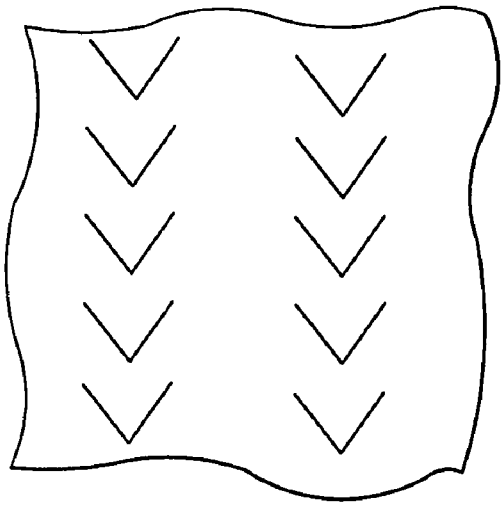
FIG. 2 shows part of a downhole filter in accordance with an embodiment of another aspect of the present invention.
Figure 3:
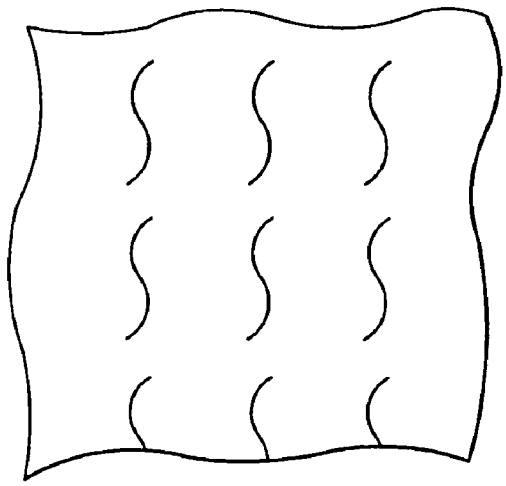
FIG. 3 shows part of a downhole filter in accordance with an embodiment of a further aspect of the present invention.

Reference is now made to FIGS. 2 and 3 of the drawings, which shows alternative, serpentine, slot forms, in particular a chevron-form in FIG. 2, and a sine wave-form in FIG. 3.

If desired, the tubulars may be reinforced by providing reinforcing ribs, which may be integral with the tubing wall or welded or otherwise fixed thereto, allowing a greater density of slots, thus providing a high-inlet-flow area. The ribs may extend in any desired direction, depending upon the nature of the reinforcement which is required or desired. In other embodiments, the wall of the tubular may be corrugated, to increase crush resistance, as described in applicant's PCT\GB2003\002880, the disclosure of which is incorporated herein by reference.

Figure 4:
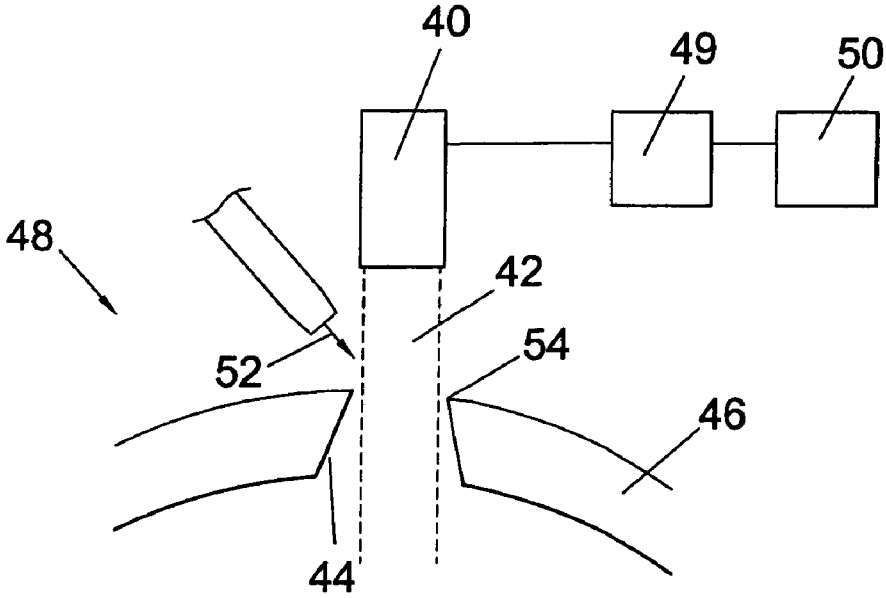
FIG. 4 is a schematic view of a step in the creation of a filter in accordance with an embodiment of a still further aspect of the present invention.

Reference is now made to FIG. 4 of the drawings, which is a schematic view of a step in the creation of a filter in accordance with an embodiment of a still further aspect of the present invention. In particular, the figure shows a laser-cutting operation, with a laser-cutting head 40 producing an energy beam 42 which is utilised to cut a slot 44 in the wall 46 of a metal tubular 48.

The head 40 and tubular 48 are mounted for relative movement to permit the desired slot forms to be cut, whether these are longitudinal slots, circumferential slots, or serpentine slots.

The energy input to the head 40 from the associated power source 50 is controlled by a computer-controlled unit 49 such that, when the head 40 is producing an energy beam and is stationary relative to the tubular 48, the energy input is reduced such that the resulting slot width is the same as that produced when the head 40 is cutting a slot while moving relative to the tubular 48.

The laser-cutting head 40 is provided in conjunction with a purge gas outlet, from which a jet of inert gas 52 is directed onto and around the cutting area. This gas 52 protects the hot metal from oxidisation and also carries away the vaporised and molten metal produced by the cutting operation. The gas 52 also has the effect of rapidly cooling the hot metal in the vicinity of the cut. The resulting quenching effect has been found to harden the metal, and in particular has been found to harden the slot outer edges 54.

Figure 5:
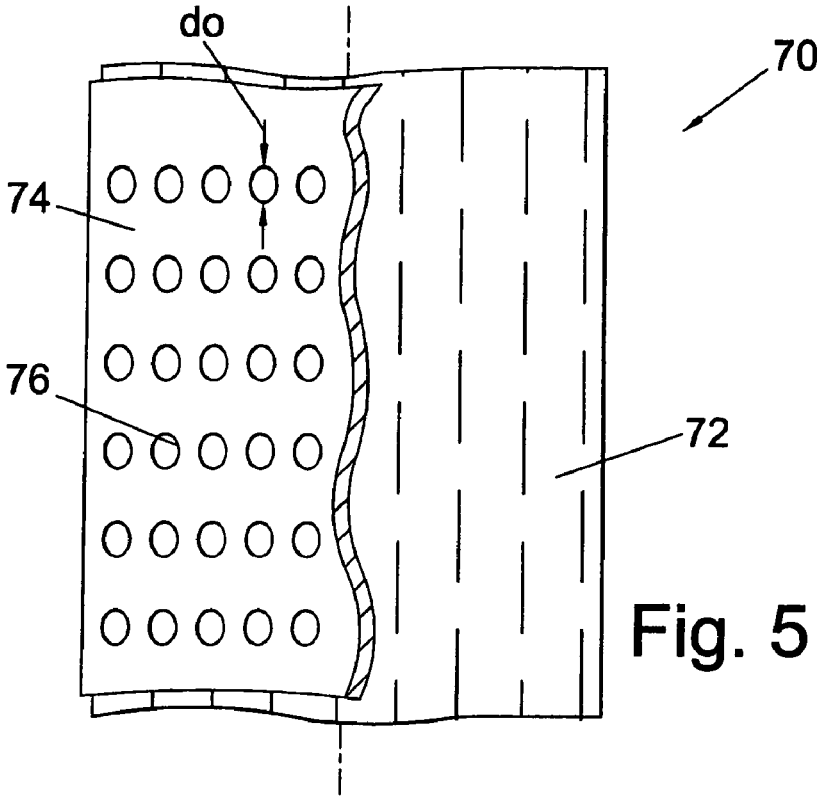
FIG. 5 is a schematic illustration of part of a filter in accordance with an embodiment of another aspect of the present invention.

FIG. 5 is a part-sectional illustration of part of another form of laser-cut filter, and in particular shows part of an expandable downhole filter arrangement 70 comprising an expandable slotted base tube 72 and a deformable metal filter sheet 74 mounted over and around the base tube 72, the filter sheet 74 defining a plurality of laser-cut perforations 76. The laser-perforated sheet 74 is initially provided in planar form, and then wrapped around the base tube 72. The edges of the sheet may be joined by any convenient method, such as a seam weld.

Figure 6:
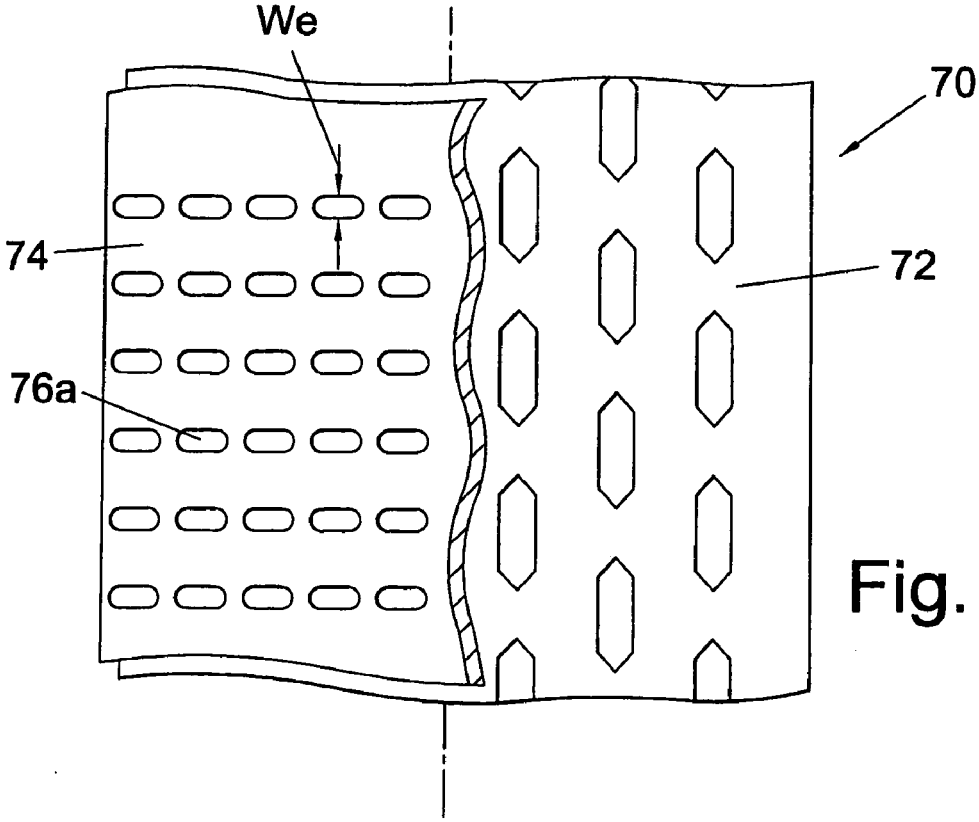
FIG. 6 is a view of part of a filter sheet of the filter of FIG. 5, shown following diametric expansion of the filter.

It will be noted that the perforations 76 are substantially circular, and on expansion of the filter arrangement 70 to a larger diameter, with corresponding diametric expansion of the filter sheet 74, the perforations 76 assume the form of elongate slots 76*a*, as illustrated in FIG. 6 of the drawings, of width we less than the diameter do the original perforations.

The diametric expansion may be achieved by any convenient method, but preferably utilises an rotary expansion tool.

The laser-cut perforations 76 have a keystone or trapezoidal section, which form is retained in the extended slots 76*a*, and the filter sheet 74 is arranged such that the narrower or smaller diameter end of the perforations is adjacent the outer face of the filter sheet.

It has been found that the laser-perforated filter sheet 74 is sufficiently robust to obviate the requirement to provide a protective shroud around the exterior of the sheet 74, thus simplifying the manufacture of the expandable filter arrangement 70.

Those of skill in the art will appreciate that the above-described embodiments are merely exemplary of the present invention, and that various modifications and improvements may be made thereto without departing from the scope of the invention. For example, although the various filters and filter arrangements are described above with reference to downhole filtering applications, other embodiments may have utility in sub-sea or surface filtering applications.

The invention claimed is:

1. A downhole filter comprising a tubular member having a wall defining at least one opening, at least a portion of the opening having an outer width less than an inner width, wherein an edge portion of the at least one opening is hardened by a quenching process.

2. The filter of claim 1, wherein said outer width defines the minimum width of the opening.

3. The filter of claim 1, wherein said portion of said opening defining said outer width is located on an outer circumference of the tubular member.

4. The filter of claim 1, wherein the opening has a keystone form.

5. The filter of claim 1, wherein the opening is created by laser-cutting.

6. The filter of claim 1, wherein the opening is created by abrasive water jet cutting.

7. The filter of claim 1, wherein the opening is in the form of a slot and extends longitudinally of the tubular member.

8. The filter of claim 1, wherein the opening is in the form of a slot and extends circumferentially of the tubular member.

9. The filter of claim 1, wherein the opening is in the form of a slot and extends helically of the tubular member.

10. The filter of claim 1, wherein the opening is in the form of a serpentine slot.

11. The filter of claim 1, wherein the tubular member is diametrically expendable.

12. The filter of claim 11, wherein the wall of the tubular member incorporates extendible portions.

13. The filter of claim 11, wherein the wall of the tubular member has at least one substantially circular opening therein which opening is adapted to assume a circumferentially-extending slot-form of smaller width than the original substantially circular opening, following diametric expansion of the tubular member.

14. The filter of claim 1, wherein the wall of the tubular member defines a plurality of openings.

15. The downhole filter of claim 1, further comprising a deformable filter sheet disposed around the exterior of the tubular member, the deformable filter sheet having one or more perforations.

16. The downhole filter of claim 15, wherein the tubular member and the filter sheet are expandable.

17. The downhole filter of claim 15, wherein the one or more perforations are laser cut.

18. The downhole filter of claim 1, wherein the quenching process comprises directing an inert gas onto the cutting area.

19. A wellbore filter comprising a tubular member having at least one opening therethrough, the at least one opening having a serpentine configuration, wherein an edge portion of the at least one opening is hardened by a quenching process.

20. A method of filtering wellbore fluids, the method comprising:

placing a downhole filter within a wellbore, the downhole filter comprising a tubular member defining at least one opening, at least a portion of the opening having an outer width less than an inner width, wherein an edge portion of the opening is hardened by a quenching process; and passing wellbore fluids into an interior passage of the tubular member through the opening.

21. The method of claim 20, further comprising sizing the outer width of said opening to filter wellbore particulate matter of a predetermined diameter.

22. A downhole filter arrangement comprising a tubular member having a wall defining at least one laser-cut perforation, wherein an outer edge portion of the perforation has been quenched.

23. The filter arrangement of claim 22, wherein the tubular member is formed of metal.

24. The filter arrangement of claim 22, wherein the wall of the tubular member defines a plurality of laser-cut perforations.

25. The filter arrangement of claim 22, wherein the perforation is in the form of a slot of constant width along the length of the slot.

26. The filter arrangement of claim 25, wherein the slot is of serpentine form.

27. The filter arrangement of claim 22, wherein the perforation has an outer width less than an inner width.

28. A method of filtering wellbore fluids, the method comprising:

forming a downhole filter, comprising:

forming at least one opening in a wall of a tubular, at least a portion of the opening having an outer width less than an inner width; and quenching an edge portion of the opening;

placing the downhole filter within a wellbore; and passing wellbore fluids into an interior passage of the tubular through the at least one opening.

29. The method of claim 28, wherein quenching the edge portion comprises directing an inert gas onto the cutting area.

30. The method of claim 28, wherein forming the at least one opening comprises controlling an energy beam from a laser-cutting head such that a width of the at least one opening produced while the head is stationary is the same as when the head is moving.

* * * * *